US006555974B1

(12) United States Patent
Cline et al.

(10) Patent No.: US 6,555,974 B1
(45) Date of Patent: Apr. 29, 2003

(54) WIRING GEOMETRY FOR MULTIPLE INTEGRAL LAMPS

(75) Inventors: Wayne J. Cline, Geneva; Gordon A. Grigor, Cleveland Heights; Louis R. Nerone, Brecksville, all of OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/717,747

(22) Filed: Nov. 21, 2000

(51) Int. Cl.[7] ..... H05B 37/00

(52) U.S. Cl. ..... 315/312; 315/200 R; 315/201; 315/324

(58) Field of Search ..... 315/312, 324, 315/201, 200 R, 209 R, 225, 226, 246, 268, 272, 291, 307

(56) References Cited

U.S. PATENT DOCUMENTS

| | | | | |
|---|---|---|---|---|
| 2,295,657 A | | 9/1942 | Hodgkins | 315/58 |
| 2,351,305 A | | 6/1944 | Thayer | 315/58 |
| 3,549,941 A | | 12/1970 | Friedmann | 315/58 |
| 3,753,071 A | | 8/1973 | Engel et al. | 315/DIG. 7 |
| 3,996,493 A | | 12/1976 | Davenport et al. | 315/58 |
| 4,042,819 A | | 8/1977 | Dacal | 240/51.11 R |
| 4,092,562 A | * | 5/1978 | Campbell | 315/324 |
| 4,109,307 A | | 8/1978 | Knoll | 315/224 |
| 4,204,139 A | | 5/1980 | Shimer et al. | 315/58 |
| 4,259,614 A | | 3/1981 | Kohler | 315/219 |
| 4,268,780 A | | 5/1981 | Roche et al. | 315/179 |
| 4,293,799 A | | 10/1981 | Roberts | 315/256 |
| 4,316,121 A | | 2/1982 | Hammer et al. | 315/62 |
| 4,353,007 A | | 10/1982 | Moerkens et al. | 315/62 |
| 4,508,996 A | | 4/1985 | Clegg et al. | 315/224 |
| 4,571,526 A | | 2/1986 | Wesselink | 315/56 |
| 4,740,873 A | | 4/1988 | Blake | 362/116 |
| 4,751,435 A | | 6/1988 | Roche et al. | 315/235 |
| 4,792,726 A | | 12/1988 | Gandhi | 315/52 |
| 4,857,806 A | | 8/1989 | Nilssen | 315/72 |
| 4,939,420 A | | 7/1990 | Lim | 315/58 |
| 5,047,696 A | | 9/1991 | Nilssen | 315/312 |
| 5,189,339 A | | 2/1993 | Peshak | 315/58 |

(List continued on next page.)

FOREIGN PATENT DOCUMENTS

| | | |
|---|---|---|
| DE | 195 12 307 A1 | 2/1996 |
| GB | 1 401 628 | 7/1975 |
| WO | WO91/16802 | 10/1991 |
| WO | WO96/31996 | 10/1996 |

*Primary Examiner*—Don Wong
*Assistant Examiner*—Thuy Vinh Tran
(74) *Attorney, Agent, or Firm*—Fay, Sharpe, Fagan, Minnich & McKee, LLP

(57) ABSTRACT

A multiple integrated lamp system is powered by a power source. The system includes a first integral lamp having lamp electronics and a lamp integrated as a single unit, and a second integral lamp having lamp electronics in a lamp also integrated as a single unit. A first connection wire is connected from a first pin of the first integral lamp to a second pin of the first integral lamp. A second connection wire is connected from a first pin of the second integral lamp to a second pin of the second integral lamp. A first power line is connected at a first end to the power source, at a second end to a third pin of the first integral lamp, and at a third end to a third pin of the second integral lamp. Further, a second power line is connected at a first end to the power source, at a second end to a fourth pin of the second integral lamp, and a third end to a fourth pin of the second integral lamp.

16 Claims, 4 Drawing Sheets

U.S. PATENT DOCUMENTS

| | | | | |
|---|---|---|---|---|
| 5,208,511 | A | 5/1993 | Garbowicz | 315/106 |
| 5,294,865 | A | 3/1994 | Haraden | 315/58 |
| 5,331,253 | A | 7/1994 | Counts | 315/209 R |
| 5,341,068 | A | 8/1994 | Nerone | 315/219 |
| 5,406,177 | A | 4/1995 | Nerone | 315/307 |
| 5,485,057 | A | 1/1996 | Smallwood et al. | 315/58 |
| 5,541,477 | A | 7/1996 | Maya et al. | 313/493 |
| 5,654,609 | A | 8/1997 | Smallwood et al. | 315/56 |
| 5,710,487 | A | 1/1998 | Valcke | 315/205 |
| 5,712,526 | A | 1/1998 | Fulop et al. | 313/493 |
| 5,720,546 | A | 2/1998 | Correll, Jr. et al. | 362/221 |
| 5,796,214 | A | 8/1998 | Nerone | 315/209 R |
| 5,907,218 | A | 5/1999 | Altman et al. | 315/56 |
| 5,952,790 | A | 9/1999 | Nerone et al. | 315/209 R |
| 5,965,985 | A | 10/1999 | Nerone | 315/DIG. 4 |
| RE36,414 | E | 11/1999 | Tickner | 362/235 |
| 6,018,220 | A | 1/2000 | Nerone | 315/219 |
| 6,078,143 | A | 6/2000 | Nerone | 315/209 R |

* cited by examiner

WIRING GEOMETRY FOR MULTIPLE INTEGRAL LAMPS

BACKGROUND OF THE INVENTION

The present invention is directed to integral lamps, and to the wiring connections used for operation of multiple integral lamps in an installation such as a fixture or housing.

Lamp systems including a lamp and electronics, supplied by a power source are known in the art. A problem with known lamp systems is that existing connection schemes between the power source, lamp and lamp electronics, do not allow for the electronics to be an integral part of the lamp. Rather, the electronics are commonly set apart from the lamp within the system housing or fixture.

Attempts to closely attach the lamp and the electronics require at least one conductor wire to extend the length of the lamp envelope to a second heater element to connect the second heater element to the lamp electronics. This conductor wire may be positioned along the inner or outer surface of the lamp envelope.

Thus, in existing systems, a wiring connection is provided directly from the electronics controlling operation of the lamp to the opposite end of the lamp. Therefore, wherein prior art lighting systems include multiple lamps, extensive wiring connections between the lamps and electronics are required.

It has therefore been considered beneficial to design a lamp system where the lamp electronics are positioned on an end of the lamp in an integral relationship with the lamp, whereby the integral lamp/lamp electronics unit may be removed as a single component from the housing of the system. It has been considered to be a further desirable aspect to have a simplified wiring arrangement for multiple integral lamps in a single installation, such as a fixture or housing.

SUMMARY OF THE INVENTION

A multiple integrated lamp system is powered by a power source. The system includes a first integral lamp having lamp electronics and a lamp integrated as a single unit, and a second integral lamp having lamp electronics and a lamp also integrated as a single unit. A first connection wire is connected from a first pin of the first integral lamp to a second pin of the first integral lamp. A second connection wire is connected from a first pin of the second integral lamp to a second pin of the second integral lamp. A first power line is connected at a first end to the power source, at a second end to a third pin of the first integral lamp, and at a third end to a third pin of the second integral lamp. Further, a second power line is connected at a first end to the power source, at a second end to a fourth pin of the second integral lamp, and a third end to a fourth pin of the second integral lamp.

DETAILED DESCRIPTION OF THE PREFERRED EMBODIMENTS

Figure 1:
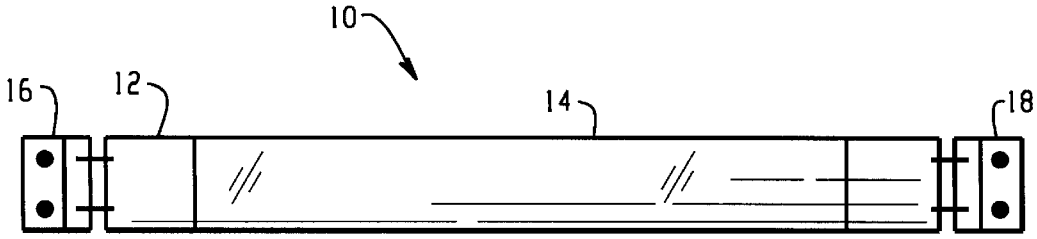
FIG. 1 illustrates a lamp/lamp electronics unit which may be used in the present invention.

FIG. 1, shows a diagram for one embodiment of an integral lamp 10 which may be used in the present invention. In this design lamp electronics 12 are integrated with lamp 14, which may be a gas discharge lamp such as a linear fluorescent lamp. Lamp electronics 12 are connected at one end to an end connector 16, and lamp 14 is connected to a second end connector 18. For convenience, the power source and external wiring are not shown.

In FIG. 1, no external or internal conductor wire extends along the length of lamp 14 from the integrated end of lamp electronics 12 and lamp 14 to the opposite end of lamp 140 Rather, and as will be explained in more detail below, the wiring connection within the lamp housing connects to end connectors 16, 18 in such a manner that a complete electrical path is provided to operate the lamp 14/lamp electronics 12 configuration of integral lamp 10. Thus, by use of the design in FIG. 1 a user may easily remove lamp electronics 12 and lamp 14 as a single unit thereby increasing the ease with which no longer functioning units may be replaced.

Figure 2:
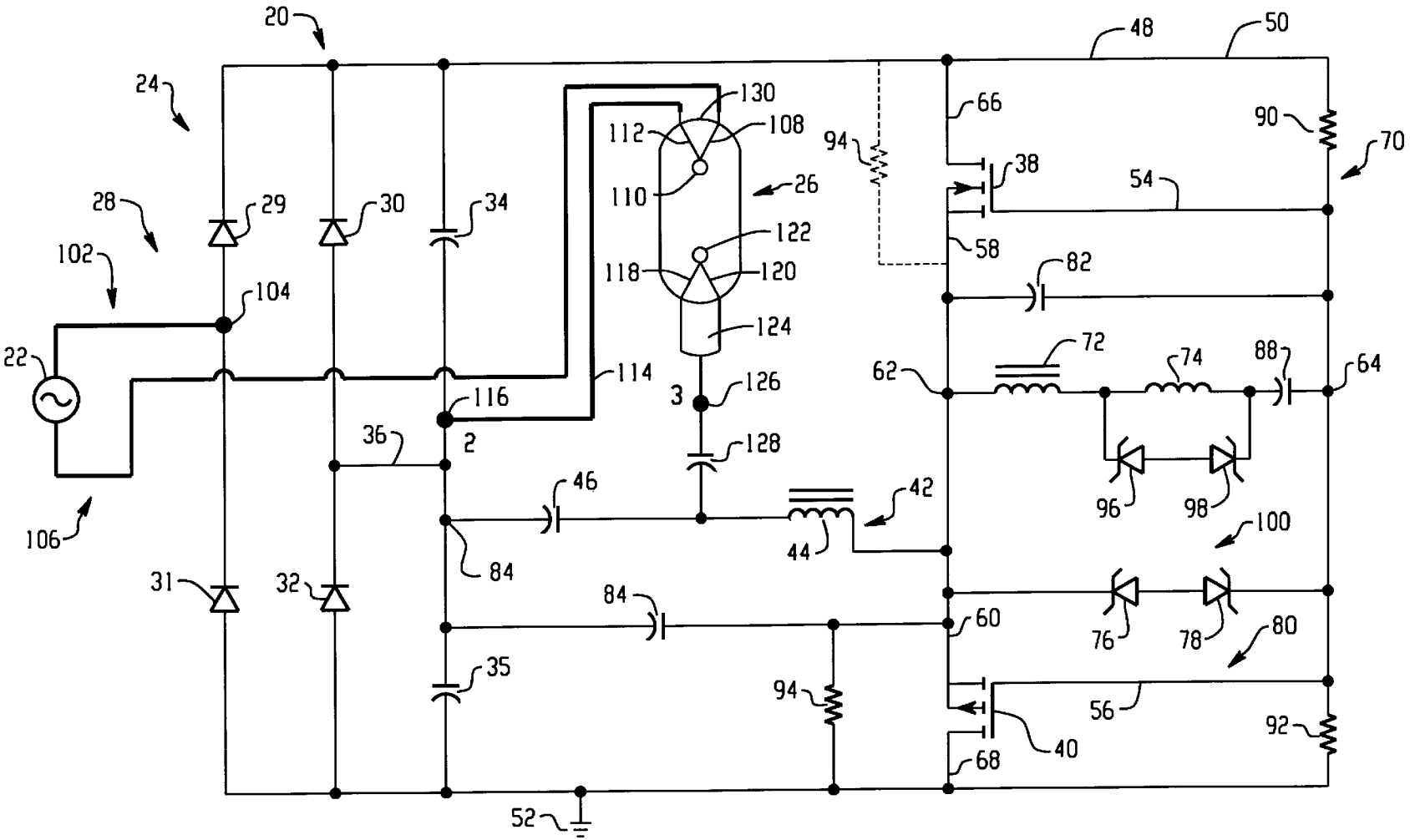
FIG. 2 depicts a detailed circuit diagram for a lamp system which may be used in accordance with the present invention.

Turning to FIG. 2, illustrated is a lamp 20 which may be used in connection with the present invention, supplied by power source 22 which supplies power to lamp electronics 24, which in turn controls operation of a gas discharge lamp, such as a linear fluorescent lamp 26.

Power source 22, which may be an a.c. source, supplies current to an a.c.-to-d.c. rectifier, which may be a full-wave bridge rectifier 28, formed by diodes 29, 30, 31, 32. An electromagnetic interference (emi) filter (not shown) suppresses conducted emissions produced by a high frequency inverter. A non-electrolytic smoothing capacitor configuration 34, 35 is connected between diodes 30, 32 by a connection line 36.

Switches 38 and 40 are respectively controlled to convert d.c. current from rectifier 28 to a.c. current received by resonant load circuit 42, including resonant inductor 44 and resonant capacitor 46. D.c. bus voltage 48, exists between bus conductor 50 and reference conductor 52, shown for convenience as a ground. Resonant load circuit 44 also includes lamp 26, which may be shunted across resonant capacitor 46.

Switches 38 and 40 are complementary to each other in the sense, for instance, that switch 38 may be an n-channel enhancement mode device as shown, and switch 40 a p-channel enhancement mode device as shown. These are known forms of MOSFET switches, but Bipolar Junction Transistor switches could also be used, for instance. Each switch 38 and 40 has a respective gate, or control terminal 54, 56. The voltage from gate 54 to source 58 of switch 38 controls the conduction state of that switch. Similarly, the voltage from gate 56 to source 60 of switch 40 controls the conduction state of that switch. As shown, sources 58 and 60 are connected together at a common node 62. With gates 54 and 56 interconnected at a common control node 64, the single voltage between control node 64 and common node 62 controls the conduction states of both switches 38 and 40. The drains 66 and 68 of the switches are connected to bus conductor 50 and reference conductor 52, respectively.

Gate drive circuit 70, connected between control node 64 and common node 62, controls the conduction states of switches 38 and 40. Gate drive circuit 70 includes a driving inductor 72 that is mutually coupled to resonant inductor 44 and is connected at one end to common node 62. The other end of inductor 44 may be a tap from transformer winding inductors 72 and 44. Driving inductor 72 provides the driving energy for operation of gate drive circuit 70. A second inductor 74 is serially connected to driving inductor 72. As will be further explained below, second inductor 74 is used to adjust the phase angle of the gate-to-source voltage appearing between nodes 62 and 64. A pair of diodes 76, 78 configured as a bi-directional voltage clamp 80 between nodes 62 and 64 clamps positive and negative excursions of gate-to-source voltage to respective limits determined, e.g., by the voltage ratings of the back-to-back Zener diodes shown. A capacitor 82 is preferably provided between nodes 62 and 64 to predictably limit the rate of change of gate-to-source voltage between nodes 62 and 64. This beneficially assures, for instance, a dead time interval in the switching modes of switches 38 and 40 wherein both switches are off between the times of either switch being turned on.

Beneficially, the use of gate drive circuit 70 of FIG. 2 results in the phase angle between the fundamental frequency component of the resonant voltage between node 84 and node 62 and the current in resonant load circuit 42 to be approaching 0° during ignition of the lamp. Angular frequency $\omega_R$ is the frequency of resonance of resonant load circuit 42. At resonance, lamp voltage is at its highest value. It is desirable for the lamp voltage to approach such resonant point during lamp ignition. This is because the very high voltage spike generated across the lamp at such point reliably initiates an arc discharge in the lamp, causing it to start. In contrast, during steady state operation, the lamp operates at a considerably lower voltage, at a higher angular frequency $\omega_{SS}$. Now referring to the phase angle between the fundamental frequency component of resonant voltage between nodes 62 and 84 and the current in resonant load circuit 42, this phase angle tends to migrate towards 0° during lamp ignition. In turn, lamp voltage migrates towards the high resonant voltage, which is desirable, as explained, for reliably starting the lamp.

With continuing attention to FIG. 2, the starting circuit may also include an optional snubber capacitor 86. Further provided is a coupling capacitor 88, connected between node 62 and inductor 74, that becomes initially charged, upon energizing of rectifier 28, via resistors 90, 92 and 94. At this instant, the voltage across capacitor 88 is zero, and during the starting process, serial-connected inductors 72 and 74 act essentially as a short circuit, due to the relatively long time constant for charging capacitor 88. With resistors 90, 92, 94 being of equal value, for instance, the voltage on node 62, upon initial bus energizing, is approximately ⅓ of bus voltage 48, while the voltage at node 64, between resistors 90 and 92 is ½ of bus voltage 48. In this manner, capacitor 88 becomes increasingly charged, from left to right, until it reaches the threshold voltage of the gate-to-source voltage of upper switch (e.g., 2–3 volts) 38. At this point, upper switch 38, switches into its conduction mode, which then results in current being supplied by switch 38 to resonant load circuit 42. In turn, the resulting current in the resonant load circuit causes regenerative control of first and second switches 38 and 40 in the manner previously described.

During steady state operation of lamp electronics 24, the voltage of common node 62, between switches 38 and 40, becomes approximately ½ of bus voltage 50. The voltage at node 64 also becomes approximately ½ bus voltage 50, so that capacitor 88 cannot again, during steady state operation, become charged so as to again create a starting pulse for turning on switch 38. During steady state operation, the capacitive reactance of capacitor 88 is much smaller than the inductive reactance of driving inductor 72 and inductor 74, so that capacitor 88 does not interfere with operation of those inductors.

Resistor 94 may be alternatively placed as shown in broken lines, for shunting upper switch 38, rather than lower switch 40. The operation of the circuit is similar to that described above with respect to resistor 94 shunting lower switch 40. However, initially, common node 62 assumes a higher potential than node 62 between resistors 90 and 92, so that capacitor 88 becomes charged from right to left. The results in an increasingly negative voltage between node 64 and node 62, which is effective for turning on lower switch 40.

Resistors 90 and 92 are both preferably used in the circuit of FIG. 2; however, the circuit will function substantially as intended with resistor 92 removed and using resistor 94 as shown in solid lines. The use of both resistors 90 and 92 may result in a quicker start at a somewhat lower line voltage. The circuit will also function substantially as intended with resistor 90 removed and using resistor 94 as shown in dashed lines. Additionally resistors 90, 92 and 94 are non-critical value components, which may be 100 k ohms or 1 megohm each, for example. Preferably such resistors have similar values, e.g., approximately equal. Diodes 96, 98 are used as a voltage clamp 100, which limits the amplitude of the lamp voltage.

As will be expanded upon below, lamp electronics 24 and lamp 26 are configured to permit lamp electronics 24 and lamp 26 to be formed as a single integrated unit. In FIG. 2, power line connection 102 from power source 22 is used as a direct connection point to lamp electronics 24 at center point 104 (node 1) between diodes 29 and 30. Thus, power line 102 is placed directly between two diodes of fill bridge rectifier 28. A second power line 106 from power source 22 is connected to a first end or terminal 108 of filament 110. The second end or terminal 112 of filament 110 is connected to connection wire 114 which is connected to center point 116 (node 2) between capacitors 34 and 35. Capacitors 34 and 35 are non-electrolytic or dry capacitors which are used for smoothing the input from rectifier 28. This configuration results in the power source 22 being directly connected to the lamp electronics 24. Connection line 36 connects diodes 30, 32 of rectifier 28 to capacitors 34, 36.

Another or second side of lamp 26 has a first end or terminal 118 and a second end or terminal 120 of filament 122 shorted together by line 124. The shorted terminals are connected together at connection point 126 (node 3) to capacitor 128. By this connection scheme terminals 118, 120 are connected to resonant inductor 44 and resonant capacitor 48, through capacitor 128. As an additional aspect or embodiment to the foregoing, terminals 108 and 112 may be shorted by optional line 130. The shorting of the terminals may be done to improve overall system efficiency by limiting cathode losses. The shorting of the terminals is preferably undertaken internally within an end cap holding the lamp electronics. Using this design, when the lamp unit is removed the connection is also removed from the system. The concept of incorporating the lamp electronics within an end cap will be discussed in greater detail in following sections of the discussion. From the foregoing it can be seen that the present embodiment teaches a three terminal (node) lamp network as opposed to prior art systems that employ a four terminal (node) network.

Figure 3:
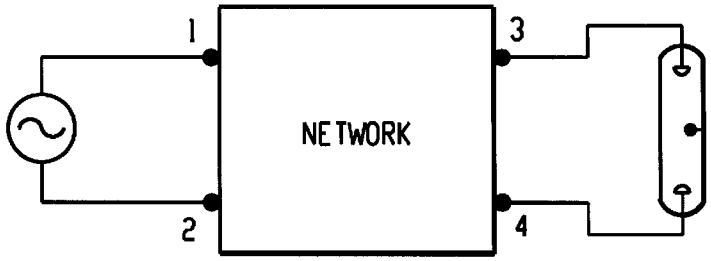
Fig. 3 PRIOR ART
FIG. 3 shows a block diagram of a four terminal (node) lamp connection configuration of the prior art.
Figure 4:
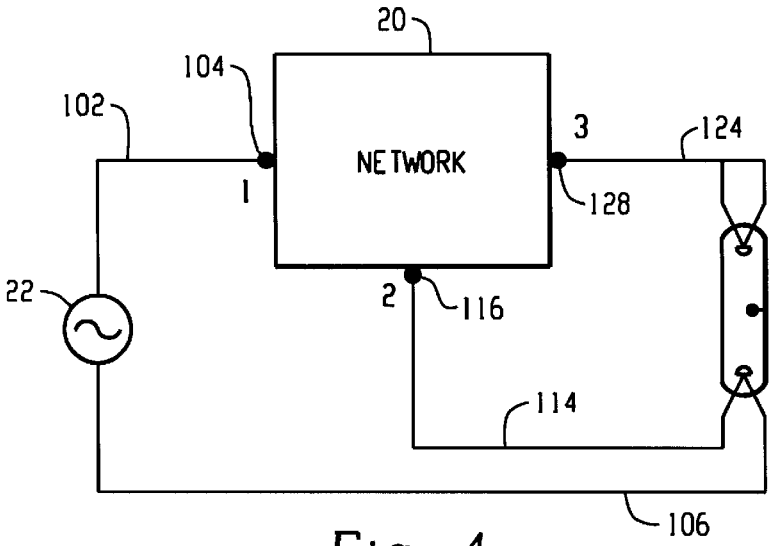
FIG. 4 illustrates a block diagram of a three terminal (node) lamp connection configuration for a lighting system which may be used in connection with the present invention.

In conventional lighting systems, terminal 112 would not be connected to terminal 1 16 (node 2). In other words, connecting line 114 would not exist. Further, line 106 would not connect terminal 108 to the power source 22. Rather, the power source would be directly connected to the rectifier 28. In existing instant start systems, terminals 108 and 112 may be connected together in order to short the cathode, and would be connected to an output within its lamp electronics. Therefore, and as can be seen more clearly in FIG. 3, conventional lamp systems have two dedicated inputs (nodes 1, 2) and two dedicated outputs (nodes 3, 4). However, in a lamp system which may be used to achieve the present innovation, and as shown in the block diagram of FIG. 4, there is a single dedicated input (node 1), a dual-function input/output (node 2), and a single dedicated output (node 3). This connection scheme eliminates the need for a conductor to be provided along side or inside the length of the lamp. Rather, in the present embodiment the connecting wire to the opposite side of the lamp is run within the fixture. It is possible to run this wire within the fixture, and not directly connected to the lamp electronics since the connections are made to one side of the power line, e.g. line 106. The lamp electronics output and input are now one connection. This means that the pin which goes to the input of lamp power source 22 serves as an input and an output (line 106).

Use of non-electrolytic capacitors 30 and 32 provides a high-power factor for starting of the linear lamp 26. Non-electrolytic capacitors 30 and 32, are low in value which is beneficial to providing a high power factor. However, due to their low value, they have a tendency to quickly enter a discharge state at times when they are not being charged. Diodes 30 and 32 prevent capacitors 34 and 35 from charging in the reverse directions.

Figure 5:
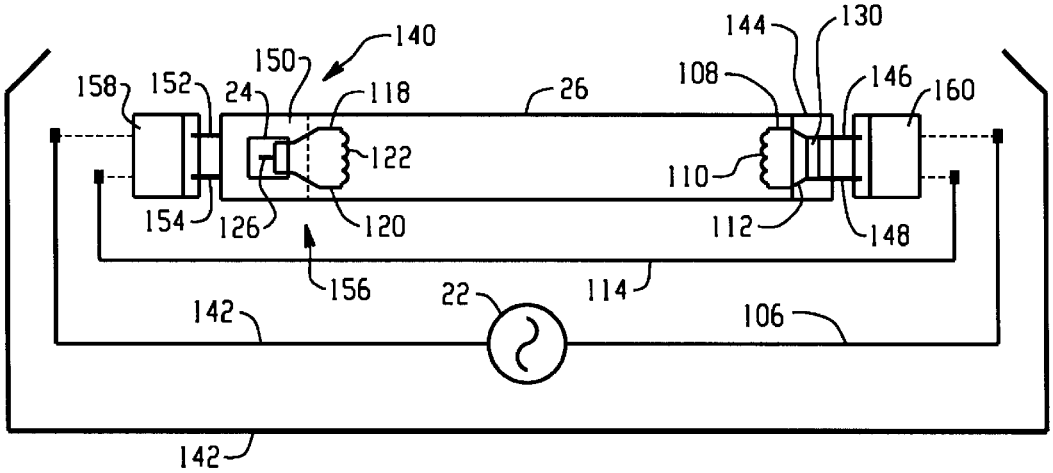
FIG. 5 depicts a circuit configuration of the present invention emphasizing the integral nature of the lamp.

Turning attention to FIG. 5, depicted is lamp electronics 24 and linear fluorescent lamp 26 formed as a single lamp/lamp electronics unit 140, connected within lamp housing or fixture 142. An end cap 144 having pins 146, 148 is permanently connected to one end of lamp 26. This connection may be made by connecting electrical terminals 108, 112 to end cap 146. At the opposite end, lamp electronics end cap 150 is configured with an interior section to hold lamp electronics 24, and is connected to lamp 26 by terminals 118, 120. Lamp electronics end cap 150 also has pins or connectors 152, 154 extending from an outer surface. The lamp electronics cap 150 and lamp 26 are integrally connected at connection area 156. Pins or connectors 146, 148 and 152, 154 are respectively inserted within connectors 158, 160 in a manner known in the art. Such connectors may be tombstone connectors or other connectors well known in the art.

It is noted that lamp housing or fixture 142 may be a conventionally sized housing or fixture. Lamp/lamp electronics unit 140, can be designed to be of a size to fit into such existing housing or fixtures. For example lamp/lamp electronics unit 142, may be designed of a length equal to a T8, T16 or other known lamp size. It is further to be understood that the lamp electronics end cap 150 is formed and sized such that it replaces existing end caps, which would otherwise be attached in the manufacturing process.

As to be understood, in the present invention, the attachment of power lines 102, 106 and connection line 114 are made such that upon removal of unit 140, lines 102, 106 and 114 are maintained within the housing fixture 142. Thus, unit 140 can be removed alone without the need of also removing any one of the lines 102, 106, or 114.

Figure 6:
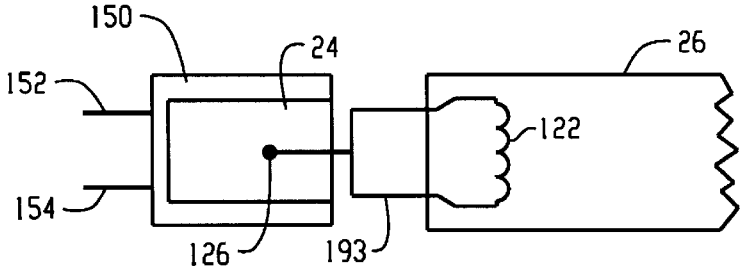
FIG. 6 depicts connection techniques for connecting the lamp electronics and lamp.

FIG. 6 illustrates the physical integration between lamp electronics 24 and lamp 26 which may be accomplished through various connection techniques. In FIG. 6, ends or terminals 118 and 120 of shorted filament 122, are connected to capacitor 128 internally in lamp electronics 24. The connection between the lamp electronics 24 and terminals 118, 120 may be accomplished through many known connection techniques including soldering, welding, wrapping, or a mechanical locking mechanism, among others.

Figure 7:
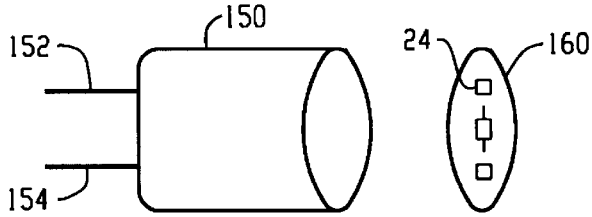
FIG. 7 illustrates the lamp electronics on a circuit board and lamp electronics cap.

Turning to FIG. 7, in one embodiment, lamp electronics 24 may be configured on a circuit board 160, but does not necessarily have to be mounted on a circuit board. This circuit board may be a single-sided or double-sided circuit board. The circuit board configuration may be substantially similar to the configuration of lamp electronics cap 150. The lamp electronics 24 carried on circuit board 160 is inserted within cap 150 and connections from lamp 26 will be made to the surface of the circuit board 160 at the appropriate locations. Pins 152, 154 will also be appropriately connected to circuit board 160 such that appropriate connections with lines 102, 106 and 114 are made to lamp electronics 24. Therefore, cap 150 is sufficiently sized to receive the circuit board 160 within its interior in a secure relationship. The board itself may be fastened within cap 150 using known processes, such as using an adhesive, soldering or other known connection techniques. Cap 150, after appropriate connections have been made to board 160, will then be integrated to lamp 26, again using known sealant and/or connection techniques. It is to be appreciated that while this circuit board configuration is disclosed in this embodiment, other configurations that are not limited to circuit boards may also be used to achieve integrated lamp/lamp electronics unit 140.

The unique configuration of each individual lamp/lamp electronics unit, or integral lamp, 140 permits a wiring scheme that allows for efficient wiring of multiple integral lamps, while still allowing for independent operation of each integral lamp. Thus, the following embodiment reduces the amount of hard wiring needed to wire multiple integral lamps in a system.

Figure 8:
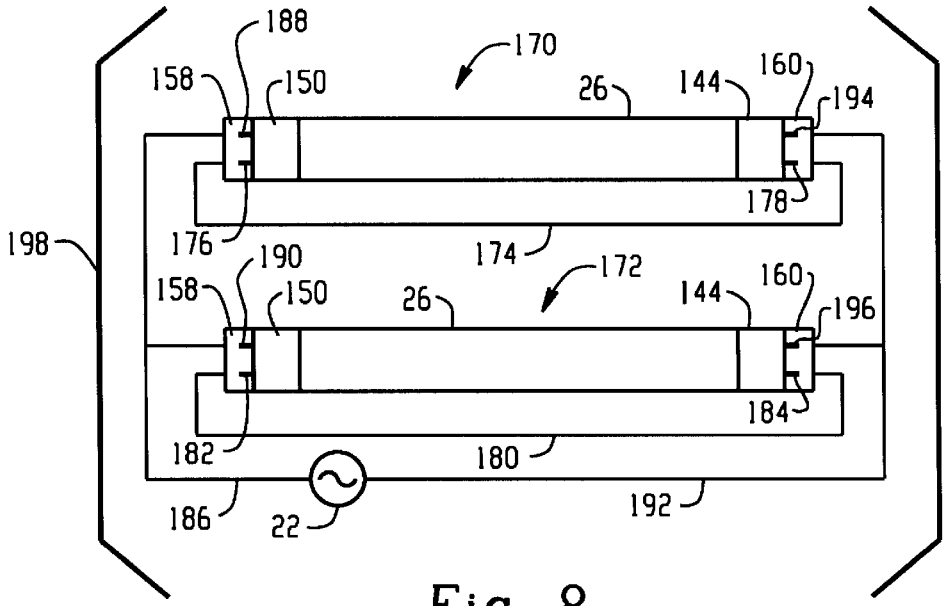
FIG. 8 depicts a first wiring configuration for a two integral lamp system.

Turning to FIG. 8, two integral lamps, 170, 172 are powered by a power source 22. It is to be appreciated that lamps 170 and 172 function in substantially the same manner as described in connection with the integral lamp 140 where lamp 26 includes an end cap 144 and a lamp electronics end cap 150 integrated as a single unit. Integral lamp 170 includes a connection wire 174 connected from a first pin 176 to a second pin 178 of integral lamp 170. Second integral lamp 172 also includes a connection wire 180 connecting a first pin 182 and a second pin 184 of integral lamp 172. First power line 186 (substantially the same as power line 102, but with further connections) is connected at a first end to power source 22, at a first second end to a third pin 188 of first integral lamp 170, and at a further end to a third pin 190 of second integral lamp 172. A second power line 192 (substantially the same as power line 106, but with further connections) is connected at a first end to power source 22. Thereafter, at a first second end, second power line 192 is connected to a fourth pin 194 of first integral lamp 170, and at another second end to a fourth pin 196 of second integral lamp 172. FIG. 8 may be included within a housing or fixture 198.

By use of an integral lamp as previously described, having only three terminals, a reduced wiring scheme for multiple integral lamp systems may be obtained. Further, the wiring scheme disclosed allows for independent operation of the multiple integral lamps with a minimum of hard wiring.

Figure 9:
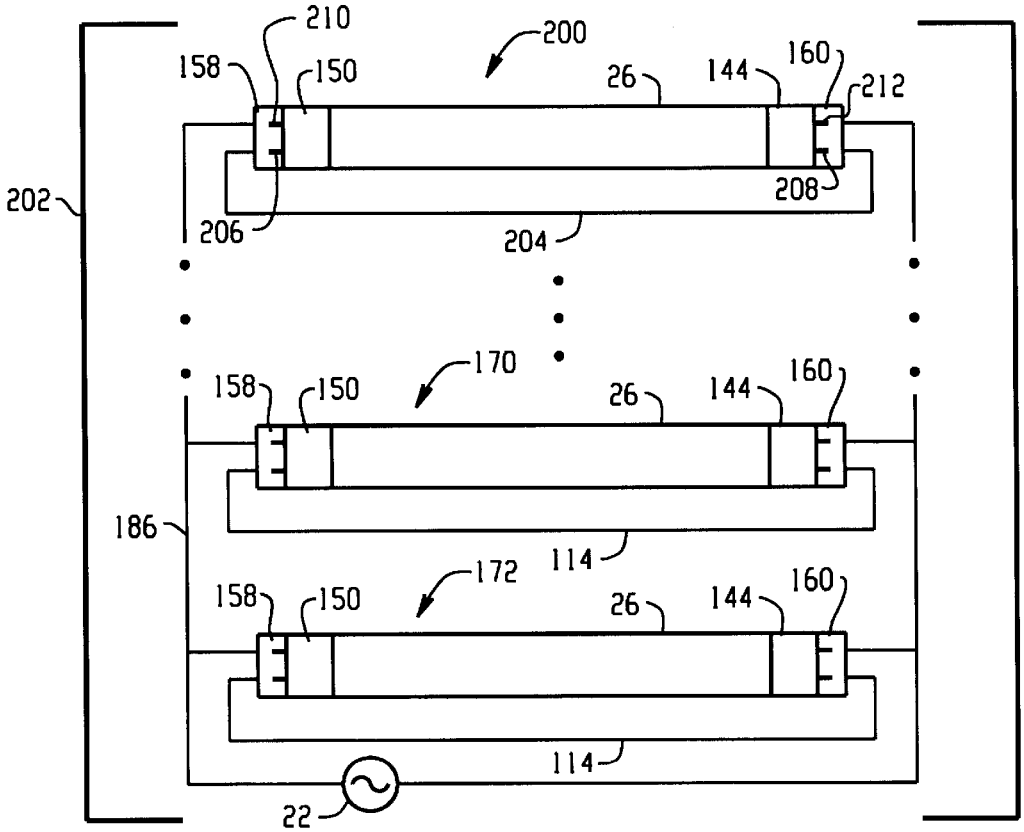
FIG. 9 illustrates wiring geometry for multiple integral lamps.

Turning to FIG. 9, a further embodiment of the present invention is illustrated. Particularly, in this embodiment, additional lamps represented by integral lamp 200 may be added to the system within a housing or fixture 202. It is noted the dots within this figure represent any number of additional lamps which may be driven by a power source 22. As additional integral lamps are added, the wiring and pin configurations previously described are undertaken. For example, connection wire 204 connects to a first pin 206 and a second pin 208 of the next integral lamp 200. Thereafter, the first power line 186 is extended to have another second end connected to a third pin 210 of integral lamp 200. Power line 192 is also extended to have another second end connected to a fourth pin 212 of lamp 200.

It is understood that the wiring configurations of FIGS. 8 and 9 implement integral lamps (140, 170, 172, 200) which permit a user to know that when a failure occurs it is the unit as a whole which needs to be replaced. Previously, in existing three or four lamp systems, when a failure would occur a lamp change alone would be made and if the system still did not work, then it would be necessary to replace the electronics. Integral lamps (140, 172, 172, 200) eliminate this uncertainty. They also eliminate the requirement of an electrician being called to replace the electronics, since no wiring changes need to be made.

In existing lamp systems, a linear fluorescent lamp will commonly have a life expectancy significantly different from lamp electronics powering the lamp. Employing the present innovation, the life of the lamp electronics and life of the lamp are more closely matched.

Further, by providing the present lamp electronics with a specific individual lamp, the lamp electronics can be more finely tuned to the operational ranges of the specific lamp with which it is integrated. This situation allows for an improvement in efficiency of operation for the lamp electronics as it controls operation of the lamp.

A further aspect of the present invention is that integral lamps (140, 170, 172, 200) may be inserted into the lamp connectors 158, 160 in any fashion without concern as to proper polarity.

The present invention also does not require the use of a shutdown circuit for the removal of the lamp. Rather, as soon as the integral lamp is removed from the connections, power is removed from the circuit.

Returning attention to FIGS. 5, 8 and 9, it is noted that in these figures power source 22 is depicted as being internal to housing or fitting 142. It is understood that this is simply for sake of convenience and the actual power supply to such housings may be external such as from a home or office lighting system.

Exemplary component values for the circuit of FIG. 2 are as follows for a fluorescent lamp 26 rated at 16.5 watts, with a. bus voltage having an average value of approximately 107 volts:

| | |
|---|---|
| Diodes 29–32 | 1N4005 |
| Resonant inductor 44 | 280 $\mu$H |
| Resonant capacitor 46 | 4.7 nF |

-continued

| | |
|---|---|
| Driving inductor 72 | 2.2 $\mu$H |
| Turns ratio between 44 and 72 | about 12 |
| Second inductor 74 | 820 $\mu$H |
| Zener diodes 76, 78, (each) | 10 volts, 1N5240 |
| Capacitor 82 | 1 nF |
| Capacitor 84 | 680 pF |
| Capacitor 88 | 2.2 nF |
| Resistors 90, 92 and 94, each | 130 kohm |
| Capacitor 128 | 22 nF |
| Smoothing capacitors (each) 34, 35 | 68 nF |
| Zener Diodes (each) 96, 98 | 51 Volt Zener diodes, 1N5262 |

Additionally, switch 38 may be an IRFR214, n-channel, enhancement mode MOSFET, sold by International Rectifier Company, of El Segundo, California; and switch 40, an IRFR9214, P-channel, enhancement mode MOSFET also sold by International Rectifier Company.

While the invention has been described with respect to specific embodiments by way of illustration, many modifications and changes will occur to those skilled in the art. It is therefore, to be understood that the appended claims are intended to cover all such modifications and changes as fall within the true spirit and scope of the invention.

What is claimed is:

1. A multiple integrated lamp system powered by a power source, the system comprising:

a first integral lamp having lamp electronics and a lamp integrated as a single unit;

a second integral lamp having lamp electronics and a lamp integrated as a single unit;

a first connection wire, connected from a first pin of the first integral lamp, to a second pin of the first integral lamp;

a second connection wire, connected from a first pin of the second integral lamp to a second pin of the second integral lamp;

a first power line connected at a first end to the power source, at a second end to a third pin of the first integral lamp, and at a third end to a third pin of the second integral lamp; and a second power line connected at a first end to the power source, at a second end to a fourth pin of the second integral lamp, and at a third end to a fourth pin of the second integral lamp.

2. The multiple integrated lamp system according to claim 1, wherein the first and second integral lamps each include:

a lamp having a first end with first end terminals, and a second end with second end terminals;

an end cap having an interior section, where the end cap is in electrical connection with the first end terminals at the first end of the lamp;

lamp electronics configured to control operation of the lamp, wherein as between the first end terminals and the second end terminals, the lamp electronics are connected only to the second end terminals; and a lamp electronics end cap, having an interior sized to hold the lamp electronics, wherein the lamp electronics are located within the interior of the lamp electronics end cap.

3. The invention according to claim 2 wherein the first and second integral lamps are each single units designed as a permanent joined structure, between the lamp electronics and lamp.

4. The invention according to claim 2 wherein the first and second integral lamps are each single units designed as a detachably joined structure, between the lamp electronics and lamp.

5. The multiple integrated lamp system according to claim 1 wherein connection between the lamp and the lamp electronics is by three node connections, a first node being used as a dedicated input, a second node being used as an input and output, and a third node being used as a dedicated output.

6. The multiple integrated lamp system according to claim 5 wherein the dedicated output is an internal connection between the lamp and lamp electronics.

7. The multiple integrated lamp system according to claim 1 wherein the lamp electronics includes:

an a.c. to d.c. rectifier for rectifying the power source, where the power source is connected at a first end to the rectifier, a smoothing capacitor configuration connected to said rectifier, a set of complementary switches connected to said smoothing capacitor configuration, each of said switches having a control terminal commonly connected to a starting capacitor, to a bi-directional clamping device and to a driving circuit, said switches being alternately activated into a conducting state to generate an a.c. signal and supplying said a.c. signal to a resonant circuit, and each of said switches having a commonly connected terminal interconnected to the resonant circuit and to the driving circuit.

8. The invention according to claim 7 wherein the smoothing capacitor configuration is a non-electrolytic capacitor configuration.

9. The invention according to claim 1 wherein the first integral lamp operates independently of the second integral lamp.

10. The system according to claim 1 further including:

a third integral lamp having lamp electronics and a lamp integrated as a single unit;

a fourth integral lamp having lamp electronics and a lamp integrated as a single unit;

a third connection wire, connected from a first pin of the third integral lamp, to a second pin of the third integral lamp;

a fourth connection wire, connected from a first pin of the fourth integral lamp to a second pin of the fourth integral lamp;

the first power line further connected at a third end to a third pin of the third integral lamp, and at a fourth end to a third pin of the fourth integral lamp; and a second power line connected at a third end to a fourth pin of the fourth integral lamp, and at a fourth end to a fourth pin of the fourth integral lamp.

11. A multiple integrated lamp system powered by a power source, the system comprising:

a plurality of integral lamps each including, a lamp having a first end with first end terminals, and a second end with second end terminals, an end cap having an interior section, where the end cap is in electrical connection with the first end terminals at the first end of the lamp, lamp electronics configured to control operation of the lamp, wherein as between the first end terminals and the second end terminals, the lamp electronics are connected only to the second end terminals; and a lamp electronics end cap, having an interior sized to hold the lamp electronics, wherein the lamp electronics are located within the interior of the lamp electronics end cap;

a plurality of connection wires, each one of the plurality of integral lamps having a connection wire of the plurality of connection wires connected from a first pin to a second pin of each integral lamp of the plurality of integral lamp;

a first power line having a first end and a plurality of second ends, the first and connected to the power source, and one of each of the plurality of second ends connected to one of each of the plurality of integral lamps at a third pin; and a second power line having a first end and a plurality of second ends, the first end connected to the power source, and one of each of the plurality of second ends connected to one of each of the plurality of integral lamps at a fourth pin.

12. The invention according to claim 11 wherein the integral lamp is designed as a permanent joined structure.

13. The invention according to claim 11 wherein the integral lamp is designed as a detachably joined structure.

14. The invention according to claim 11 wherein connection between the lamp and the lamp electronics is by three node connections, a first node being used as a dedicated input, a second node being used as an input and output, and a third node being used as a dedicated output.

15. The invention according to claim 14 wherein the dedicated output is an internal connection between the lamp and lamp electronics.

16. The invention according to claim 11 wherein each of the plurality of integral lamps operate independently of each other.

* * * * *